United States Patent [19]

Stratton et al.

[11] 4,182,122

[45] Jan. 8, 1980

[54] INSULATED EXHAUST MANIFOLD

[75] Inventors: Michael K. Stratton; Karl R. Engquist, both of Peoria; Frank E. Keske, Chillicothe; Harold C. Powers, Peoria; James D. Sparks, Edelstein, all of Ill.

[73] Assignee: Caterpillar Tractor Co., Peoria, Ill.

[21] Appl. No.: 878,141

[22] Filed: Feb. 15, 1978

[51] Int. Cl.[2] ..... F01N 7/10

[52] U.S. Cl. ..... 60/322; 60/323; 164/98; 164/108

[58] Field of Search ..... 60/272, 282, 322, 323; 164/98, 108

[56] References Cited

U.S. PATENT DOCUMENTS

| | | | |
|---|---|---|---|
| 3,486,326 | 12/1969 | Hermes | 60/322 |
| 3,727,410 | 4/1973 | Scheitlin | 60/322 |
| 3,775,979 | 12/1973 | Scheitlin | 60/322 |
| 3,864,908 | 2/1975 | LaHaye | 60/272 |
| 3,901,029 | 8/1975 | Kondo | 60/323 |

*Primary Examiner*—Douglas Hart

*Attorney, Agent, or Firm*—Wegner, Stellman, McCord, Wiles & Wood

[57] ABSTRACT

An exhaust manifold for an internal combustion engine is provided with internal insulation so as to maintain the outside skin temperature preferably below 450° F. The manifold is provided with an exhaust conduit or lining that is comprised of interfitting relatively axially movable sections in contact with the exhaust gases. A low specific gravity or porous sleeve of insulating material is fitted in slightly spaced relationship around the exhaust conduit. The sleeve of insulating material may be wrapped to prevent the metal of the outer cast manifold housing from penetrating the insulation. Each section of the exhaust conduit has a branch for connection to a flanged nipple which is permitted some limited movement relative to the manifold housing when connected to the exhaust ports of the engine.

17 Claims, 3 Drawing Figures

INSULATED EXHAUST MANIFOLD

BACKGROUND OF THE INVENTION

1. Field of the Invention

This invention relates to internal combustion engines and, more particularly, to internally insulated manifolds for said engines.

2. Description of the Prior Art

There has been considerable development work on engine exhaust manifolds that are internally insulated with the view to maintaining the manifold housing temperature below a predetermined limit. One such manifold has a cast ferrous inner conduit surrounded by insulation, which in turn, is covered by a cast outer manifold. This construction is substantially impractical in that the inner casting will rupture due to thermal fatigue since no provision has been made for relieving the thermal stresses.

In another construction, hard alumina and silica are cast with metallic fibers embedded therein to form a liner. The housing is cast about the liner. The resulting manifold is impractical since it has been found that alumina is subject to surface fatigue due to temperature cycling which produces a fine dust that goes out the exhaust. Aside from the dust problem, it has been found that the structure will not hold up over a period of time.

A third construction calls for an inner liner of refractory fibers and refractory binder with a cast metal manifold on top of it. The cast metal penetrates the insulation during the casting. In time, with the insulation rigid, the outer casting ruptures and, with the insulation not rigid, the insulation fatigues out.

And still another construction has a thermally insulating core of relatively fragile material surrounded by a softer cushioning material and a cast metal sheet on the outside. There is no provision for preventing thermal fatigue of the liner and, therefore, the solution is undesirable.

SUMMARY OF THE INVENTION

The present invention is directed to overcoming one or more of the problems as set forth above.

According to the present invention, an exhaust manifold is provided that is insulated on the inside to maintain the external housing of the manifold below a predetermined temperature while maintaining warpage of the manifold due to thermal growth and metallographic changes at a tolerable minimum. The improved manifold will not leak and is capable of withstanding repetitive cycling and temperatures without thermal fatigue.

The improved manifold is comprised of an internal exhaust conduit having a plurality of axially relatively slidable sections, with each section having a branch connected to an exhaust port of an engine. The joints between adjacent sections is a slip joint and permits axial expansion and contraction of the conduit as the temperature of the exhaust gases vary. An insulation member is molded or cast to size and is assembled around the exhaust conduit with a narrow air gap between the exhaust conduit and the insulation member. The air gap will act, in a minor sense, as an air insulation and, more importantly, will prevent excessive erosion of the insulation member due to leaking of exhaust gases at the slip joints between the sections of the exhaust conduit. The insulation member and lining may be wrapped and an outer housing may be cast in place or assembled thereabout.

A flanged sleeve extends into the openings for each port of the manifold, which sleeves can be welded or slip fit on the ends of the branches or stubs of the exhaust conduit. When the exhaust manifold is bolted to the engine block, the flange on the sleeve is permitted some minor movement by the flange nesting in an undercut portion of the casting.

A manifold is provided which has a skin temperature not to exceed 450° F., has long life, is not subjected to failure from thermal fatigue, and does not have a problem with warpage due to thermal growth and the like.

BRIEF DESCRIPTION OF THE DRAWINGS

The details of construction and operation of the invention are more fully described with reference to the accompanying drawings which form a part hereof and in which like reference numerals refer to like parts throughout.

In the drawings.

DESCRIPTION OF THE PREFERRED EMBODIMENT

Figures 1, 2, 3:
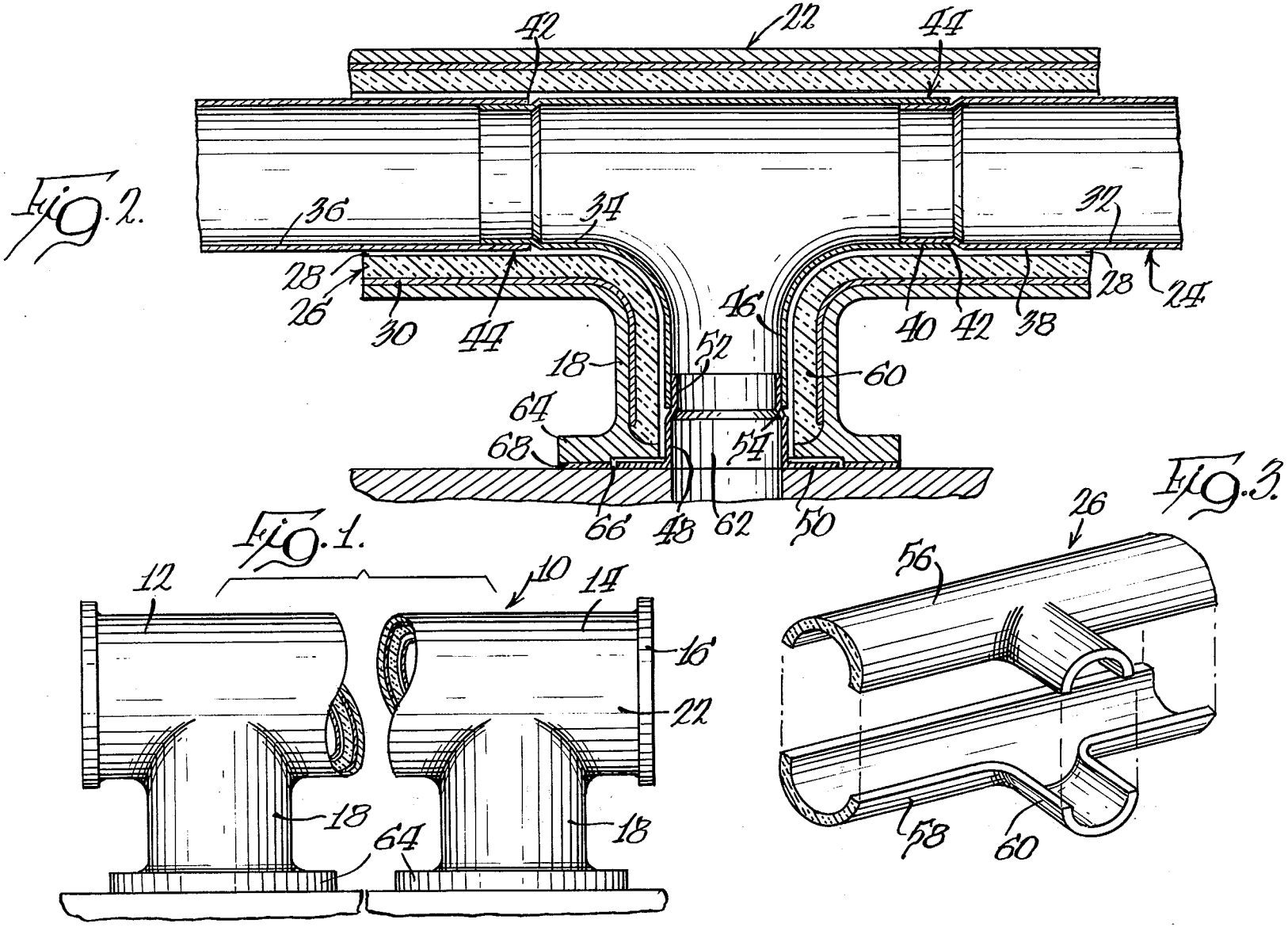
FIG. 1 is a side elevational view of the two end portions of our improved manifold with the center portion broken away.
FIG. 2 is a vertical cross-sectional view taken through one port of the manifold and showing the insulation and exhaust conduit in position therein; and, FIG. 3 is an exploded perspective view of a portion of the molded or cast sleeve of insulating material used in our improved manifold.

The improved manifold 10 is shown for use on an internal combustion engine. The manifold 10 has one end portion 12 adapted to be connected to a turbocharger or other exhaust outlet system for a vehicle and has an opposite end portion 14 which is closed off by an end plate 16. The manifold 10 can have an appropriate number of port branches 18 to coincide with the number of exhaust ports in the cylinder head. As shown in FIG. 1, two port branches 18 are illustrated connected to the end portions 12,14 of the manifold 10, with a broken away section in between which could have two or more additional port branches therebetween.

The manifold 10 is comprised of an outer manifold casting 22 and an inner exhaust conduit or lining 24. Between the lining 24 and the casting 22, there is provided a member 26 of insulating material, which member 26 is spaced from the lining 24 by a small or narrow air gap 28. The member 26 of insulation material may have a wrap 30 wound around the outer periphery thereof in order to prevent locking the outer casting 22 to the insulation material due to metal penetrating the pores of the insulation.

More specifically, the inner exhaust conduit or lining 24 is comprised of a plurality of individual sections, three being shown, 32,34,36 with one end portion 38 of each section having a step-down or reduction in diameter to form a reduced end portion male connector 40. The end portion male connector 40 of each section, such as section 32, is adapted to slide into the open end 42 of an adjacent section, such as section 34, to form a slip joint 44 between said sections 32,34. Each section 32,34, 36, and the like, of the exhaust conduit 24 is normally only as long as the spacing between adjacent ports in the engine block. That is, each section has one branch 18 for connection to one port so that there is a slip joint 44 between each adjacent pair of cylinders. Each section, in this case section 34, has a stub port 46 extending at an angle, such as 90° for example, to the axis of the section. As shown, the stub port 46 terminates short of the mouth of the port branch 18 for each cylinder.

The exhaust conduit or lining 24 has each section 32,34,36, and the like, made of thin wall stainless steel which is of suitable composition to resist corrosion, sulphidation, oxidation at 1400° F., erosion of material due to high gas velocities and pressure pulses and thermal fatigue. An example of a material that has been found to operate successfully in SAE 347 type Stainless Steel. This is part of the Class 18-8 Stainless Steel which is ductile and requires no heat treatment after welding.

The cross-sectional shape of the exhaust conduit or lining 24 can be rectangular, circular, oval, or the like, and generally the branch ports 18 will, likewise, be of any desired shape. It has been found, however, that a circular cross section for the exhaust conduit 24 and a circular cross section for the branch ports 18 is preferred since it provides maximum strength with the least complexity in forming.

Each branch port 18 has a flanged sleeve 48 extending between the port stub 46 and the surface of the cylinder head when the manifold 10 is attached to an engine. The port sleeve 48 has an integrally formed flange 50 flared outwardly at right angles to the axis of said sleeve 48 and has a reduced end portion 52 which is adapted to slide into the open end 54 of the stub port 46. The joint between the port sleeve 48 and the stub port 46 can be a slip fit, but it can also be welded by means of welding through the opening in the sleeve 48 in a manner to be described hereinafter.

The member 26 is made of a low specific gravity, porous insulation material and is comprised of a pair of mating halves 56,58 split along a plane containing the longitudinal axis of the insulation member. The plane also splits the port stubs 60 down the middle so that the two identical halves 56 and 58, when assembled together, produce the insulation member 26 with the appropriate number of port stubs 60. As illustrated in FIG. 3, only one port stub 60 is shown, but it is to be understood that the insulation member 26 generally will be formed in such a way that the appropriate number of port stubs 60 will be provided so that when the insulation member 26 is assembled half 56 to half 58 and placed over a lining 24, the insulation member 26 will extend continuously from one end to the other of the lining 24.

The insulation member 26 is formed from commercially available materials which have appropriate heat transfer coefficients for the limited thickness allowed for the insulation member. That is, in a majority of situations, the insulation member 26 is limited in thickness to not more than one-half inch. The criterion that should be used in selecting the manifold insulation is to be sure to have a heat transfer coefficient that approximates the following: $K \leqq 0.06$BTU/hr/ft/°F., otherwise, the insulation will get to be too thick. In practice, one very desirable and successful insulating material is the material known under the trademark THIEMSUL PINK manufactured by Thiem Corporation of Milwaukee, Wisconsin, which is a commercial product consisting of fibers made from aluminum oxide and silicon oxide plus organic binder. Another example would be the trademarked product KALMIN 5000 made by Foseco, a British company. This material also consists of fibers made from aluminum oxide and silicon oxide, but in this case the binder is inorganic. The exact compositions, firing temperatures, shrinkage factors, and the like, are known to the manufacturers of those products and no claim is made in this application to the details or the composition of the insulating material.

With the two halves 56,58 of the insulation member 26 assembled together over the exhaust conduit or lining 24, they are aligned by end restraints so as to provide the small air gap 28 between the lining 24 and the insulation member 26. As an alternative, it is possible to provide spacers, such as chaplets, on the surface of the lining 24 which will act to space the insulation member 26 from the lining 24. The insulation member 26 is spaced from the exhaust conduit or lining 24 by a small amount, such as from 1 to 5 millimeters, although greater clearance would work, but it would be at the expense of the thickness of the insulation member 26. Since insulation material generally is a better insulator than air, it is desirable to maximize the thickness of the insulation member 26 while still maintaining an adequate air gap 28 for the intended purpose.

Air gaps between a lining and an insulation member, as such, are not new nor is a slip joint between the sections of a lining. However, the slip joints have been a problem in the past in that they leak and erode the surrounding insulation. In our invention, the leakage of exhaust gases at the slip joints 44 is in no way a detriment because the lining 24 protects the insulation member 26 from thermal fatigue, erosion, mechanical loading by gas pulses, and the like. The small air gap 28, first, reduces, to a point of insignificance, the erosion of the insulation member 26 caused by hot gas pulses coming through the slip joints 44 and, second, reduces the amount of mechanical loading upon the insulation member 26 caused by deflections of the lining 24 which arise from mechanical loading by gas pulses from the cylinders. If the joints between the adjacent sections 32,34,36, and the like, of the exhaust conduit or lining 24 only abut each other, it would be necessary to use a secondary lining at the joints which, when combined with the small air gap 28, will create no erosion of the surrounding insulation member 26.

With the two halves 56,58 of the insulating member 26 in place around the lining 24, it may be necessary to have a fibrous or relatively weak wrap 30 wrapped around the insulation member 26 in order to prevent the locking of the outer casting 22 to the insulation due to the metal penetrating the pores in the insulation. The penetration of the metal into the insulation subjects the insulation member 26 to rupturing due to thermal fatigue, since it cannot expand at the same rate as the insulation. If the insulation material is both strong and rigid, such as bonded alumina phosphate, then it is highly desirable to have the wrap 30 wrapped therearound.

The outer casting 22 is preferably made of cast iron, however, any metallic casting of conventional composition, such as aluminum based alloys is satisfactory. The outer casting 22 does not have to be subdivided into sections as does the lining 24 because the temperature swings of the casting are relatively low. That is, the temperature extremes of the casting 22 should be ambient to 450° F. maximum. Except for very long manifolds, the improved manifold has a casting 22 that will neither warp nor leak and can be clamped tightly against the cylinder head of the engine.

The casting 22 may be formed directly on the insulation member 26 by placing the wrapped insulation member 26 and exhaust conduit or lining 24 in a core box and then cast in a conventional manner. The casting 22 has port branches 18 with outwardly extending flanges 64 which are undercut at 66 concentric with the port opening 62 in the branch. A port sleeve 48 is inserted in each port branch 18 with the reduced portion 52 of the sleeve 48 slip fitting over the end 54 of the port stub 46 of the lining 24. If desired, the port sleeve 48 may be welded to the port stub 46 by manipulating the welding equipment through the port opening 62 of the branch 18. The flange 50 of each port sleeve 48 nests in the undercut 66. The depth of the undercut 66 in the flange 64 is slightly greater than the thickness of the material forming the flange 50 of the port sleeve 48 so that when the manifold 10 is placed up against a gasket 68 on the side of the cylinder and bolted thereto, a small degree of movement of the flange 50, sleeve 48 and attached lining section 34 is tolerated as the temperature of the exhaust gases increases to the 1400° F. level. In some cases, the recess in the flange can be formed by counterboring, which counterbore must, likewise, be slightly deeper than the thickness of the flange 50. In the alternative, if the gasket 68 does not go under the flange 50, but only under the cast flange 64, the depth of the counterbore could be slightly deeper than the thickness of the flange 50 minus the thickness of the gasket 68 between the flange 64 and the cylinder head.

The space between the lining 24 and the outer casting 22 assumes the average pressure in the exhaust manifold soon after the engine stabilizes at any particular operating point. Pressure pulses, severe as they may be within the lining 24, are very small in the space between the lining 24 and the outer casting 22, mostly because the slip joints 44 are relatively tight in relation to their length (which makes for a very low natural frequency of the system treated as a Helmholtz resonator). For instance, fluctuations of sixty inches of mercury within the lining 24 may result in only a fraction of one inch of mercury in the space between the lining 24 and the casting 22 in spite of the fact that it "pumps up" to the average pressure in a turbocharged engine of, say, fifty inches of mercury absolute (which is the level of supercharge).

As illustrated, a plate or cover 16 is secured over the end of the casting. However, it is to be understood that since the manifold casting 22 is cast in place around the insulation member 26 and the lining 24, the end can be integrally cast along with the casting. Likewise, the end section 32 of the lining 24 will be closed off at one end as will the end of the insulation member 26. In other words, at the far end portion 14 of the manifold 10 there will be a lining section, i.e. 32, with a closed end, which end will be spaced by a small air gap 28 from a closed end of the insulation member 26. The wrap 30, when used, will encircle the end of said member 26 so that the casting 22 can encompass the end of the manifold.

In summary, an exhaust conduit 24 made up of a plurality of interfitting sections 32,34,36, and the like, is surrounded by an insulation member 26 spaced from the lining or exhaust conduit 24 by a small air gap 28. Depending upon the material of the insulation member 26, the member may or may not be wrapped with a thin wrap 30 whereupon the outer casting is cast directly to the insulation member 26. The flanged sleeves 48 are inserted in each port branch 18 with a slip joint 44 between the inner ends of the sleeves 48 and the port stub 46 of the sections 32,34,36 of the lining 24. However, it is to be understood that port sleeves 48 may be welded to the port stubs by manipulating welding equipment through the port opening 62. The flange 50 of the sleeves 48 rests in a counterbored portion 66 of the flange 64 of the port branches 18 so as to permit some limited degree of movement of the sections 32,34,36 of the lining 24 relative to the casting 22 as the exhaust port branches 18 and exhaust conduit 24 receives heated exhaust gases. The sections 32,34,36 of the exhaust conduit or lining 24 have slip joints 44 between the end portions thereof so that each one can move relative to the other. In this way, the accumulative elongation effect of the heating of the lining 24 is not transmitted to the outer casting 22 of the manifold. Small air gaps 28 between the sections 32,34,36 of the lining 24 and the insulation member 26 prevents erosion of the insulation member 26 by exhaust gases passing through the slip joints 44 at the ends of the sections 32,34,36 of the lining 24. The surface temperature of the casting 22 does not exceed 450° F. even with the exhaust gases operating at approximately 1400° F. The insulation member 26 serves to insulate the outer casting 22 from the extreme temperatures inside the lining 24 so that the skin temperature of the casting 22 will not exceed the 450° F. temperature. The design of the manifold 10 is such as to prevent thermal stresses and thermal fatigue of the insulation and of the casting 22, erosion of the insulation member 26 is avoided, and the lining 24 is permitted to expand or contract so as to accommodate for the temperature changes caused by the exhaust gases.

The embodiment of the invention in which an exclusive property or privilege is claimed is defined as follows:

1. An insulated manifold for an internal combustion engine having an outer casting with a plurality of integrally formed port branches extending sidewardly from said casting, an exhaust conduit in said casting and having integrally formed port stubs extending into said port branches, a preformed insulation member encircling said exhaust conduit and having integrally formed port stubs encircling said port stubs of said exhaust conduit and being disposed in said port branches of said casting, said insulation member being spaced from said exhaust conduit to provide a small air gap therebetween, and a sleeve nesting in each port branch and connecting with said port stub of said exhaust conduit whereby in use the skin temperature of said casting is maintained within allowable limits.

2. In an insulation manifold as claimed in claim 1 wherein said sleeve has a flange nested in an undercut portion of a flange on said port branch.

3. In an insulated manifold as claimed in claim 1 wherein said exhaust conduit is comprised of at least two axially aligned sections, and wherein said means for permitting expansion of the conduit comprises a slip joint between adjacent ends of said sections whereby the sections may expand without elongating the length of said exhaust conduit.

4. In an insulated manifold as claimed in claim 3 wherein said sections of said exhaust conduit are made of thin wall stainless steel.

5. In an insulated manifold as claimed in claim 3 wherein said slip joint is comprised of a reduced end portion on one section which slips into an open end of an adjacent section.

6. In an insulated manifold as claimed in claim 1 wherein said insulation member is comprised of insulating material that has a transfer coefficient approximating K≦0.06BTU/hr/ft/°F.

7. An insulated manifold for an internal combustion engine having an outer casting with a plurality of port branches extending sidewardly from said casting, an exhaust conduit in said casting and having port stubs extending into said port branches, an insulation member encircling said exhaust conduit and having port stubs encircling said port stubs of said exhaust conduit and being disposed in said port branches of said casting, said insulation member is porous and is in two mating parts which are assembled over said exhaust conduit, said insulation member being spaced from said exhaust conduit to provide a small air gap therebetween, and a sleeve nesting in each port branch and connecting with said port stub of said exhaust conduit whereby in use the skin temperature of said casting is maintained within allowable limits.

8. In an insulated manifold as claimed in claim 7 wherein said insulation member is spaced from said exhaust conduit by an amount between 1 and 5 mm.

9. In an insulated manifold as claimed in claim 3 wherein said sleeve has a slip fit with the end of said port stub of said section and said sleeve has a flange nested in an undercut portion in a flange on said port branch whereby said sleeve and section of the conduit may shift relative to said port branch and casting.

10. In an insulated manifold as claimed in claim 1 wherein a thin wrap is provided around said insulation member inside said casting.

11. An insulated manifold for an internal combustion engine comprising an exhaust conduit having integrally formed port stubs extending sidewardly therefrom, means on said exhaust conduit for permitting expansion of said conduit without increasing the assembled length of said conduit, a preformed insulation member encircling said exhaust conduit and having integrally formed port stubs encircling said port stubs of said exhaust conduit, said insulation member being spaced from said exhaust conduit to provide a small air gap therebetween, a one-piece casting encircling said insulation member and said exhaust conduit and having integrally formed port branches encircling said port stubs of said insulation member and said exhaust conduit, and a flanged sleeve nesting in each port branch and connecting with the port stub of said exhaust conduit whereby in use the skin temperature of said casting is maintained within allowable limits.

12. An insulated manifold for an internal combustion engine comprising an exhaust conduit having at least two axially aligned sections, an integrally formed port stub extending sidewardly from each section, means on said aligned sections for permitting expansion of said sections without elongating said conduit, a preformed insulation member encircling said exhaust conduit and having integrally formed port stubs encircling said port stubs of said exhaust conduit, said insulation member being spaced from said exhaust conduit to provide a small air gap therebetween, a casting encircling said insulation member and said exhaust conduit and having integrally formed port branches encircling said port stubs of said insulation member and said port stubs of said sections of the exhaust conduit, a sleeve nested in each said port branch and connecting with the port stub of said sections and a flange on each sleeve nested in an undercut portion of the port branches whereby with the manifold bolted to an engine, the flanges, sleeves and attached sections of the exhaust conduit move as the temperature of the exhaust gases increase without creating any stresses on the insulation member and casting of the manifold.

13. In an insulated manifold as claimed in claim 12 wherein said means on said aligned sections is a slip joint whereby the sections may expand without elongating the length of said exhaust conduit.

14. In an insulated manifold as claimed in claim 13 wherein said sections of said conduit are made of thin wall stainless steel.

15. In an insulated manifold as claimed in claim 14 wherein said slip joint is comprised of a reduced end portion on one section which slips into an open end of an adjacent section.

16. In an insulated manifold as claimed in claim 12 wherein said sleeve has a slip fit with the end of said port stub of said section.

17. An insulted manifold for an internal combustion engine having a one-piece outer casting, an exhaust conduit in said casting, a preformed insulation member encircling said exhaust conduit, and said insulation member being spaced from said exhaust conduit to provide a small air gap therebetween, whereby in use the skin temperature of said casting is maintained within allowable limits.

* * * * *